US011247211B2

(12) United States Patent
Appel et al.

(10) Patent No.: US 11,247,211 B2
(45) Date of Patent: Feb. 15, 2022

(54) APPARATUS FOR THE THERMAL TREATMENT OF SAMPLES

(71) Applicant: Biometra GmbH, Göttingen (DE)

(72) Inventors: Eggert Appel, Adelebsen (DE); Janek Junghans, Göttingen (DE); Konstantin Missal, Kassel (DE)

(73) Assignee: Biometra GmbH, Göttingen (DE)

( * ) Notice: Subject to any disclaimer, the term of this patent is extended or adjusted under 35 U.S.C. 154(b) by 106 days.

(21) Appl. No.: 16/591,173

(22) Filed: Oct. 2, 2019

(65) Prior Publication Data

US 2020/0101463 A1 Apr. 2, 2020

(30) Foreign Application Priority Data

Oct. 2, 2018 (DE) ..... 10 2018 124 408.8

(51) Int. Cl.
*B01L 7/00* (2006.01)

(52) U.S. Cl.
CPC ..... *B01L 7/52* (2013.01); *B01L 2300/06* (2013.01); *B01L 2300/0809* (2013.01); *B01L 2300/1805* (2013.01)

(58) Field of Classification Search
None
See application file for complete search history.

(56) References Cited

U.S. PATENT DOCUMENTS 6,153,426 A * 11/2000 Heimberg ..... B01L 3/50851 435/287.2
6,197,572 B1 * 3/2001 Schneebeli ..... B01L 3/50851 435/286.2
2009/0269835 A1 * 10/2009 Ceremony ..... B01L 7/52 435/286.2
2016/0016163 A1 1/2016 Warden et al.
2018/0360023 A1 * 12/2018 McPherson ..... A01N 1/0252

FOREIGN PATENT DOCUMENTS

| | | | | |
|---|---|---|---|---|
| CN | 106536371 | A | 3/2017 | |
| DE | 20006546 | U1 | 8/2001 | |
| DE | 10115848 | A1 | 10/2002 | |
| DE | 69826834 | T2 | 12/2005 | |
| DE | 29925002 | U1 | 6/2008 | |
| EP | 0955097 | B1 | 11/1999 | |
| EP | 1013342 | A2 | 6/2000 | |
| WO | WO-0146688 | A1 * | 6/2001 | ..... B01L 7/52 |

* cited by examiner

*Primary Examiner* — William H. Beisner

(74) *Attorney, Agent, or Firm* — Christopher R. Powers; Endress+Hauser (USA) Holding Inc.

(57) ABSTRACT

The present disclosure relates to a device for the thermal treatment of samples, including: a base unit with a receiving region; a cover for closing the receiving region, the cover movable from a first, open position into a second, closed position; at least one connecting element connected to the cover; and a cover drive disposed in the base unit and coupled to the at least one connecting element as to drive a movement of the cover such that, during the movement from an open into a closed position, the cover is initially brought from the open position into a third position, in which the cover extends parallel to and spaced from the receiving region, and such that the cover is further moved from the third position in a direction of a shared normal until the cover has reached the closed position.

17 Claims, 6 Drawing Sheets

APPARATUS FOR THE THERMAL TREATMENT OF SAMPLES

CROSS-REFERENCE TO RELATED APPLICATION

The present application is related to and claims the priority benefit of German Patent Application No. 10 2018 124 408.8, filed on Oct. 2, 2018, the entire contents of which are incorporated herein by reference.

TECHNICAL FIELD

The present disclosure relates to a device for the thermal treatment of samples.

BACKGROUND

Such a device can be a thermocycler, for example. Such devices are used to expose samples to a predetermined temperature profile, for example, for incubation or for carrying out the polymerase chain reaction (PCR), which generally takes place in a plurality of cycles in which the samples are first heated with DNA polymerase and then cooled again. A tempering block of such a device can include a plurality of receptacles for reaction vessels. These receptacles can be designed as depressions in a surface of the tempering block. The reaction vessels can be designed as receptacles formed in a microtiter plate, for example, in the form of microwells. The microwells can be formed, for example, as recesses of the microtiter plate, which can engage in corresponding receptacles in the tempering block when the microtiter plate is placed on the tempering block. However, there are also microtiter plates, for example, the so-called 1536 microtiter plates, in which the reaction vessels are formed by a honeycomb structure on a planar base surface. To control the temperature of samples present in such microtiter plates, a tempering block having a planar surface is used, which on the rear bears against the base surface of the microtiter plate when the microtiter plate is placed on the tempering block. Thermocyclers exist which are designed to press reaction vessels by way of a cover in firm thermal contact with the tempering block. For this purpose, a pressing force must be applied against the cover. For in-situ PCR or hybridization, specimen slides are known, in which the sample is applied to a surface region surrounded by a respective enclosure. Such samples applied to specimen slides can likewise be thermally treated in thermocyclers.

A generic automatically actuatable thermocycler device is known from EP 1 013 342 A2. The thermocycler described therein includes a base unit in which a receiving region with a tempering block for receiving one or more reaction vessels open at the top is present. Further, the thermocycler device includes a cover connected to the base unit via a hinge joint. The cover can be pivoted about the hinge joint, in particular, by means of a motor, so as to open and re-close the receiving region. Spring elements are arranged on the thermocycler device such that the cover and the reaction vessel or reaction vessels can be pressed against one another, and the reaction vessels are closed off directly by the cover. So as to achieve an increased pressing force of the cover against the reaction vessels, the device moreover includes an additional electrochemical linear motor which is arranged such that, once the cover has been fixed on the base unit, the cover and the reaction vessels can be pressed against each other.

The disadvantage here is, on the one hand, that two different motors are required for opening and closing the cover and for exerting a pressing force of the cover against the reaction vessels. On the other hand, shearing forces, that is forces having a horizontal force component, are exerted on the reaction vessels by the pivoting movement of the cover about the hinge joint. This can have a disadvantageous effect, for example, if a microtiter plate comprising the reaction vessels is closed and sealed by a sealing mat which is pressed between the cover and the microtiter plate. Due to the horizontal force component, the sealing mat may become undulated, bunched or displaced, in particular in the edge region, causing the reaction vessels present there to be inadequately sealed. A further disadvantage of the device described in EP 1 013 342 A2 is the relatively extensive space requirement in terms of height when the cover is being opened or closed.

EP 0 955 097 B1 discloses a thermocycler including a cover that can be closed automatically and likewise includes a base unit with a receiving region for reaction vessels containing a tempering block. The cover is coupled via pressure springs to a plate-shaped heating element, hereafter referred to as a heating plate. The cover, together with the heating plate, can be moved between a first position, in which the cover seals the receiving region and the heating plate covers the reaction vessels, and a second position, in which the cover leaves the receiving region open, or in which the heating plate does not cover the reaction vessels, by means of a cover carrier. The cover carrier is used to displace the cover along a first path segment extending parallel to the surface of the tempering block, at a predetermined distance from the tempering block, toward a stop until the cover abuts against the stop. In this position, the cover and the heating plate are aligned parallel to and vertically spaced from the heating block. By further displacing the cover carrier, the cover is moved downwardly along a second path segment until it exerts a predetermined pressure on the reaction vessels. For this purpose, the cover is guided in guide slots in opposite plates attached to the cover carrier such that the horizontal movement of the cover carrier causes a downward movement of the cover toward the reaction vessels. The pressure with which the heating plate bears against the reaction vessels when the end position of the cover is reached is determined by the shape and the course of the guide slots and by the pressure springs which press the heating plate coupled to the cover against the reaction vessel. The pressure which the heating plate exerts on the reaction vessel is thus not variable or specially adaptable to the type of reaction vessels used. Since the cover is displaced relative to the tempering block by a displacement in the horizontal direction so as to open or close the receiving region, the entire device takes up a comparatively large amount of space, in particular a large surface area on a support. This is disadvantageous with respect to efficient use of work surfaces in laboratories.

SUMMARY

The object of the present disclosure is to provide a device for the thermal treatment of samples which is improved compared to the prior art.

This object is achieved by a device according to claim 1. Advantageous embodiments are listed in the dependent claims.

The device according to the present disclosure for the thermal treatment of samples comprises:

a base unit comprising a receiving region for receiving one or more reaction vessels;

a tempering block arranged in the receiving region;

a cover for closing the receiving region which can be moved from a first, open position into a second, closed position, the cover containing a cover plate having a front surface, the front surface being intended to apply a predefinable pressing force against reaction vessels placed on the tempering block when the cover is in the second position;

at least one connecting element connected to the cover;

a cover drive which is arranged in the base unit and coupled to the at least one connecting element to drive a movement of the cover from the first position into the second position and/or from the second into the first position;

wherein the cover drive is coupled to the at least one connecting element such that, during the movement from the first into the second position, the cover together with the cover plate, in a first movement segment, is initially brought from the first position into a third position in which the front surface of the cover plate extends parallel to and spaced from the tempering block, and that the cover and the cover plate, in a subsequent second movement segment, are moved in the direction of a shared normal of the front surface and a plane in which the tempering block is arranged toward the base unit until the cover has reached the second position.

The reaction vessels can be designed, for example, as individual reaction vessels (also referred to as "tubes") or as reaction vessels combined in microtiter plates. The microtiter plate can have a planar rear side, but alternatively, the reaction vessels can also be formed as a plurality of depressions in the microtiter plate. In one embodiment, the tempering block can include a plurality of receptacles for one or more reaction vessels. A microtiter plate with plurality of depressions serving as reaction vessels can be placed on such a tempering block during operation of the tempering block module such that the individual depressions each engage in a receptacle of the tempering block. Alternatively, the tempering block can have a substantially planar surface. In this case, a microtiter plate having a flat rear side can be placed on the surface of the tempering block during operation of the tempering block module.

The reaction vessels can be closed by a sealing mat or sealing film, which is in particular self-adhesive, adjacent to the reaction vessels or the microtiter plate. A sealing mat can also be placed on and/or detachably attached to the reaction vessels. Alternatively, such a sealing mat can be detachably attached to the cover plate of the cover. In a further embodiment, the reaction vessels can also be sealed tightly by a wax plug or closure caps. In the second position of the cover, the front surface of the cover plate, corresponding to the aforementioned possible embodiments, bears directly against the reaction vessels or against a sealing mat or sealing film arranged between the cover plate and the reaction vessels so as to exert the desired pressing force on the reaction vessels.

Since, in the device according to the present disclosure, the cover is not connected to the base unit via a hinge joint, and the cover, together with the cover plate, is thus not closed in a pivoting movement about said hinge, no shearing forces are exerted by the cover plate on reaction vessels arranged in the tempering block. Rather, during the movement of the cover from the third position into the second position, the cover plate is lowered perpendicularly onto the tempering block, and the reaction vessels placed thereon, in an orientation parallel to a plane in which the tempering block is arranged, so that the front surface of the cover plate reaches all reaction vessels simultaneously when reaching the second position, and exerts a force on the reaction vessels directed exclusively perpendicular to the tempering block. Displacement or undulation of a seal covering the reaction vessels, for example of a sealing mat resting on the reaction vessels, and resulting inadequate sealing of the reaction vessels, is thus avoided. During the movement of the cover in the opposite direction, that is from the second into the third position, when the cover is being opened, the occurrence of horizontal force components on the reaction vessels or on a sealing mat resting on the reaction vessels is likewise avoided. This avoids jerky movements of the reaction vessels or of the sealing mat, which in the worst case can result in a portion of the treated sample wetting the sealing mat or the closure cap, adhering thereto and thus being lost for the further processing of the sample. The cover drive driving the movement of the cover and of the cover plate directed perpendicular to the plane of the tempering block can additionally be used to adjust a pressing force of the cover plate against the reaction vessel in a variable, and thus predefinable, manner.

The aforementioned plane in which the tempering block is arranged shall be understood here and in the following to mean an imaginary plane defined by a surface of the tempering block. As mentioned, this surface can, for example, be a substantially planar surface or include receptacles for reaction vessels. This plane is generally horizontally oriented, that is, in particular during the intended use of the device. If receptacles for reaction vessels are present, these can be designed, for example, as depressions in the surface or as for example cylindrical, receiving containers placed on the surface.

So as to drive the movement of the cover from the first position via the third position into the second position, or in the opposite direction from the second position via the third position into the first position, and to set the predefinable pressing force of the cover plate against the reaction vessels, the device described here moreover advantageously requires only a single cover drive.

The coupling of the cover drive to the cover implemented via at least one connecting element can advantageously be implemented via two connecting elements, for example, connecting plates or connecting arms, which are attached to sides of the cover located opposite each other. In all possible embodiments described below, the at least one connecting element can be designed in the form of two connecting elements arranged on opposite sides of the cover.

In one embodiment of the present disclosure, the front surface of the cover plate can be inclined with respect to the tempering block in the first position of the cover.

The cover drive can be controllable for setting the pressing force acting perpendicularly to the front surface of the cover plate, which the cover drive exerts on the cover and the cover plate via the at least one connecting element during the second movement segment, so that the pressing force (or a contact pressure) of the front surface of the cover plate against reaction vessels placed on the tempering block can be set and/or controlled by means of the cover drive.

The cover drive can have a motor, in particular an electric motor, wherein the device further comprises a drive control unit which is connected or can be connected to the cover drive and is configured to set the force which the cover drive exerts on the cover and the cover plate via the at least one connecting element, in particular based on a specification by a user or a higher-level control unit connected to the drive control unit. For this purpose, the drive control unit can comprise a processor and a memory, wherein an operating program for accordingly controlling and setting the force to be exerted is stored in the memory, and wherein the processor is configured to execute the program. A user or the higher-level control unit can thus arbitrarily set the force to be exerted by a corresponding signal to the drive control unit, which can be generated, for example, by an input of the user or in an automated manner by the control unit.

The drive control unit and/or the higher-level control unit can be further configured to generate and output a control signal representing the force to be set, based a predefined identifier of at least one reaction vessel received in the base unit. The aforementioned operating program can provide a corresponding functionality. Since it may be advantageous to set different pressing forces of the cover plate against the reaction vessels for the treatment of samples contained in different types of reaction vessels, the de 2 on vessels to be entered or read in. From the identifier, a control signal can be generated for the cover drive or the motor of the cover drive by the drive control unit and/or the higher-level control unit, so as to set a pressing force that matches the corresponding identifier.

The at least one connecting element can be rigidly coupled to the cover. If two connecting elements are present, these can accordingly both be rigidly coupled to the cover.

The at least one connecting element can be coupled to a guide arranged in the base unit in such a way that that the movement of the at least one connecting element during the second movement segment is guided linearly in the direction perpendicular to the cover plate. The cover drive can thus exert on the connecting element an arbitrarily predefinable force directed perpendicularly to the front surface of the cover plate, which also determines the pressing force with which the front surface of the cover plate is pressed against reaction vessels arranged in the tempering block.

A section of the guide which guides the movement of the at least one connecting element during the second movement segment extending between the third and the second positions can extend perpendicularly to the tempering block, that is, perpendicularly to the plane in which the tempering block is arranged.

The cover drive can comprise a rotatable drive shaft which is rigidly connected to at least one lever arm extending perpendicularly to the drive shaft, wherein the lever arm is coupled to the at least one connecting element via a guide.

In an alternative embodiment, the guide can be a linear guide for the lever arm mounted rotatably on the at least one connecting element. The linear guide can be rotatable about a rotational axis extending parallel to the drive shaft. In this way, it is possible to vary an angle enclosed between the lever arm and the connecting element, or an angle enclosed between the lever arm and an imaginary plane extending through the front surface of the cover plate, when the cover, together with the cover plate, is moved from the first into the second position or in the opposite direction.

In another possible embodiment, the guide is formed by a guide slot, arranged in the lever arm or the at least one connecting element, and at least one pin movable in the guide slot. Here and hereafter, a guide slot shall be understood to mean not only a slot that extends completely through the lever arm, but also a guide groove that is closed on one side of the lever arm. It is essential that the movable pin is guided in the guide slot along a path predefined by the guide slot.

A movement of the at least one connecting element during the first and second movement segments can be guided in a guide arranged in the base unit. For example, the at least one connecting element can have at least one coupling element, for example a pin, wherein the guide comprises a guide plate that is arranged in the base unit and has a guide slot in which the at least one coupling element is guided.

As was already mentioned, the at least one connecting element can be implemented in the form of two connecting elements arranged on opposite sides of the cover. These can be designed as connecting arms which are rigidly connected to the cover on opposite sides of the cover and extend in the perpendicular direction to the front surface of the cover plate. In this case, it is possible for there to be two guide plates or walls arranged opposite each other on different sides of the cover drive, in each of which a guide slot guiding the movement of one of the connecting elements is formed. In this embodiment, the connecting elements each comprise at least one coupling element, for example a pin, which is guided in one of the connecting slots.

In an advantageous embodiment, the cover drive comprises a self-locking gear system. The gear system can be a worm gear mechanism, for example. This can have a high gear ratio, so that it is self-locking or essentially self-locking. Other forms of self-locking gear systems are also conceivable, wherein self-locking can be produced, for example, by suitable material pairings. By means of the self-locking, it is possible to design the device in such a way that, after the second position of the cover is reached, that is, the closed end position of the cover in which the cover plate bears against the reaction vessels with the predefined pressing force, the motor of the cover drive is switched off, without the pressing force acting on the reaction vessels diminishing. If the gear system is not self-locking or not completely self-locking, the pressing force can be maintained by continuously operating the motor, optionally with a lower power consumption compared to the power consumption when moving the cover between the first and second positions. Alternatively, the base unit can also comprise a hand brake which maintains the cover position in the closed state when the gear system is not self-locking or not fully self-locking.

The base unit can comprise a housing which has at least one opening that can be closed, for example by a door or a removable wall, which allows access for manual actuation of the cover drive. This is advantageous in case the cover drive can no longer be automatically actuated due to a defect. In such a case, the device nevertheless still ensures access to the receiving area with the reaction vessels.

In a further advantageous embodiment, the base unit comprises an ejection mechanism which can be automatically actuated by one or more motors and which is used to move reaction vessels arranged in the tempering block in the direction of a normal of the plane in which the tempering block is arranged. This ejection mechanism can be designed to lift the reaction vessels off the tempering block. This makes it easier for an automatic gripper to remove the reaction vessels from the receiving area.

In one embodiment of the device, the tempering block can be arranged on or in a tempering block module, which is attached in the base unit. The ejection mechanism can comprise at least one, preferably two or more, for example four or a different number of ejection plungers, which are movably mounted in the tempering block module perpendicular thereto. The ejection plungers can be arranged on the periphery of the tempering block so that they are suitable for lifting a microtiter plate arranged in the tempering block by striking from beneath against an edge region of the microtiter plate protruding beyond the tempering block.

For driving the movement of the ejection plunger or plungers, the device can comprise one or more plunger drives arranged on the underside of the tempering block module. If a plurality of ejection plungers are present, a dedicated plunger drive is preferably assigned to each ejection plunger. In this case, the same number of plunger drives as ejection plungers is thus present. Advantageously, the plunger drives can be actuated independently of each other by means of a central control unit. For example, the drive control unit mentioned above for controlling the cover drive can additionally be designed to control the plunger drives. The plunger drives can comprise electric motors, in particular linear motors, that can be controlled by the drive control unit. The central control unit is preferably configured to control the plunger drives independently of each other, so that selectively, that is, depending on the specification of an operating program executed by the central control unit, the plungers are moved out of the tempering block module into an extended position at different times and/or moved back into a retracted position in the tempering block module, or can be moved synchronously into the extended and/or the retracted position.

BRIEF DESCRIPTION OF THE DRAWINGS

The present disclosure is explained in greater detail below based on the exemplary embodiments shown in the figures. In the figures.

DETAILED DESCRIPTION

Figure 1A:
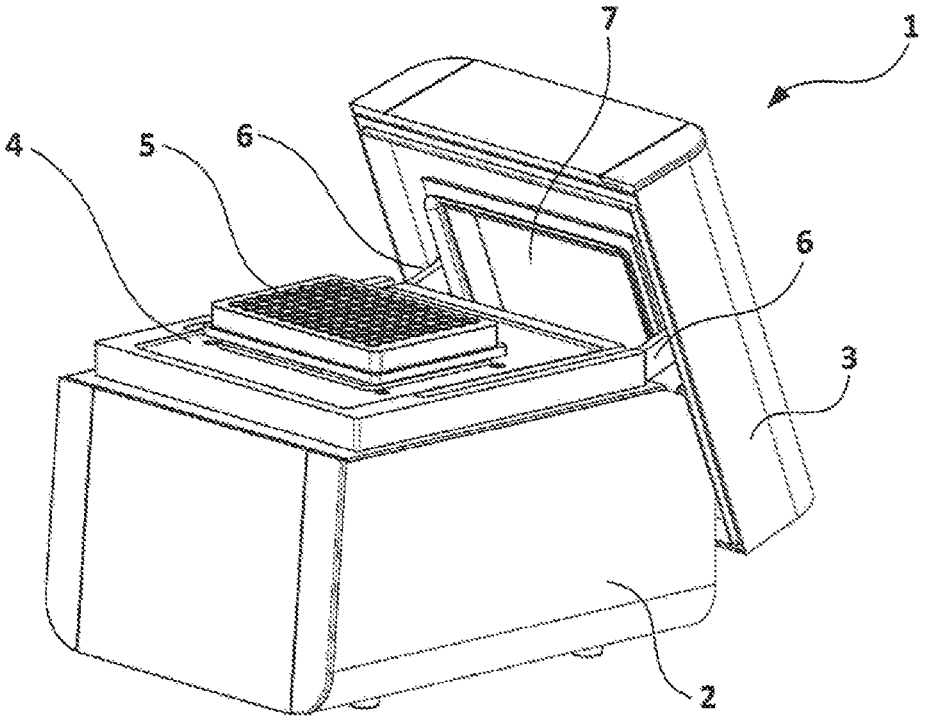
FIGS. 1*a*-1*c* show perspective views of a device for thermal treatment of samples when the cover is in different positions.

FIGS. 1*a*-1*c*, 2*a*-2*e*, 3*a* and 3*b*, 4 and 5 schematically show an exemplary embodiment for a device 1 for the thermal treatment of samples, for example, a so-called thermocycler. Identical reference numerals denote identically configured elements of the device. A plurality of identically acting modifications are possible without departing from the inventive idea.

Figure 1B:
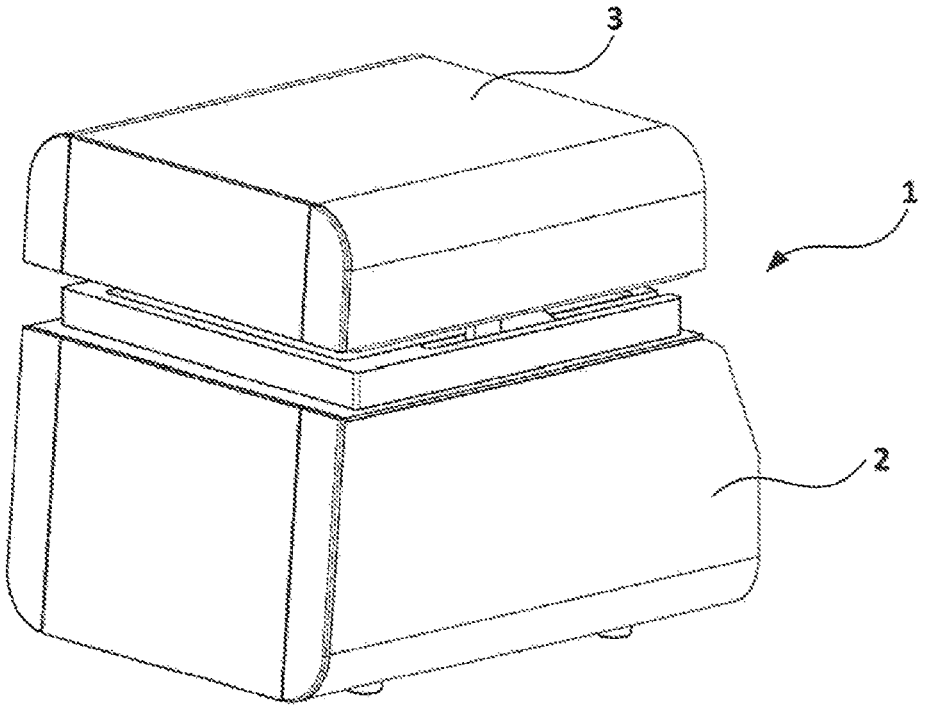
Figure 1C:
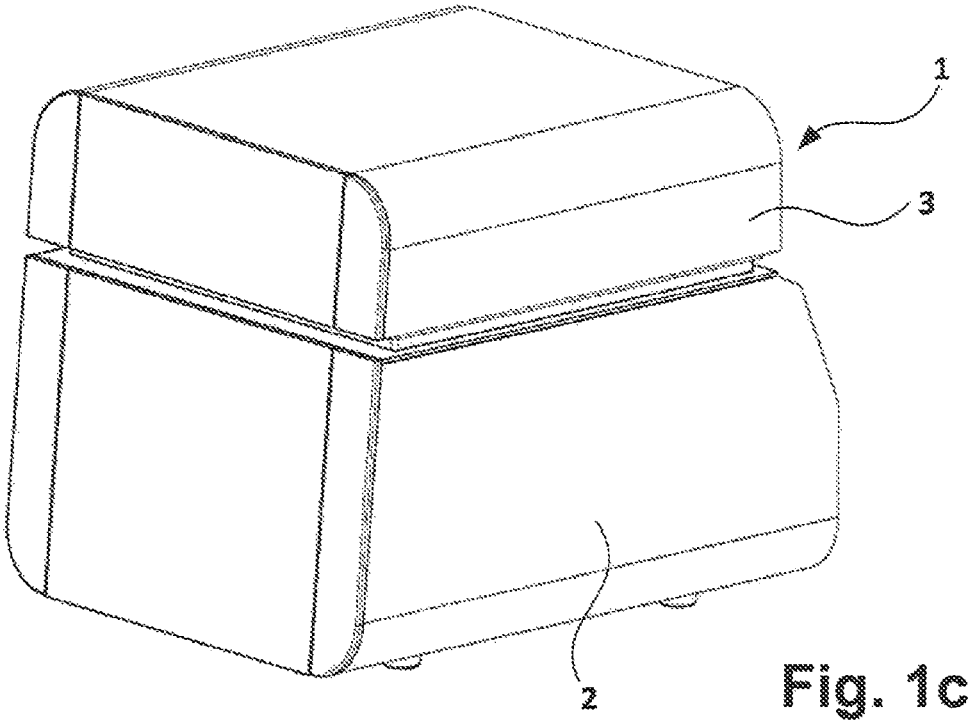

FIGS. 1*a*-1*c* show perspective views of the device 1, which possesses a base unit 2 and a cover 3, which is shown in various positions in FIGS. 1*a*-1*c*. The base unit 2 has a receiving region 4 in which a tempering block (not visible in FIGS. 1*a*-1*c*) is located. Reaction vessels in which liquid samples to be thermally treated are located can be arranged in the receiving region 4. FIG. 1*a* shows a rectangular microtiter plate 5 arranged in the receiving region 4 that has a plurality of depressions serving as reaction vessels. Such microtiter plates 5 may be made of plastic. The cover 3 is connected to the base unit 2 via two connecting elements 6, which in the present exemplary embodiment are designed as connecting arms. The connecting elements 6 are coupled to a cover drive, which is arranged in the base unit 2 and will be described in more detail below, and which can move the cover 3 for automatically opening and closing the base unit 2. Arranged in the cover 3 is a cover plate 7, the front surface of which faces the receiving region 4 and is intended to bear against the reaction vessels formed in the microtiter plate 5 when the cover 3 is closed. The cover plate 7 is designed to be heatable in the exemplary embodiment described here.

In FIG. 1*a*, the cover 3 is in an open, first position in which the cover plate 7 is inclined with respect to the surface of the microtiter plate 5. In this position of the cover 3, unimpeded access to the receiving area 4 is possible, for example for insertion or removal of the microtiter plate 5. This insertion and removal of the microtiter plate 5 can take place, for example, by means of a robot gripper arm. In combination with such a robot operating system, the device 1 can be operated completely automatically. In FIG. 1*c*, the cover 3 is in a closed, second position. In this position of the cover 3, the front surface of the cover plate 7 bears against the surface of the microtiter plate 5 or a sealing film or sealing mat covering the microtiter plate 5 with a predefinable pressing force, so that the microtiter plate 5 is pressed against the tempering block for uniform heat transfer.

FIG. 1*b* shows a third position of the cover 3, which forms an intermediate position during the movement of the cover 3 from the first into the second position or also during the movement of the cover 3 from the second into the first position. In this third position, the cover 3 is oriented parallel to the microtiter plate 5, or to the tempering block arranged beneath the microtiter plate 5, and is spaced from the surface of the microtiter plate 5.

The device 1 is designed such a movement of the cover 3 from the open, first position into the closed, second position extends over the third position. That is, the cover 3 is initially brought from the first into the third position in an arc-shaped movement in a first movement segment. From this third position, the cover 3 is moved vertically in a second movement segment, that is, perpendicularly toward the surface of the microtiter plate 5, and is thus brought into the closed, second position.

A movement of the cover 3 in the opposite direction, that is, from the second, closed position into the first, open position, likewise takes place via the third position, in that, in a first segment of this movement, the cover 3 is moved away from the microtiter plate 5 perpendicular to the surface thereof, until it reaches the third position. In a subsequent second movement segment, the cover 3 is moved from the third position into the first position in an arc-shaped movement.

In FIGS. 2*a*-2*e*, the device 1 is shown schematically in a sectional view along a first vertical sectional plane with different positions of the cover 3. In this illustration, the tempering block 13 can also be seen in FIGS. 2*a*, 2*b*, 2*c* and 2*e*. The tempering block 13 may be made of a metal having high thermal conductivity, for example, silver or aluminum, and has a plurality of receptacles for reaction vessels. In the present example, the microtiter plate 5 is placed on the tempering block 13 such that the depressions formed in the microtiter plate and serving as reaction vessels project into the receptacles. In the example shown here, the receptacles are designed as cylinders, which are situated upright on a base surface of the tempering block 13. Alternatively, the tempering block 13 can also be designed to have a substantially cuboid shape, having depressions formed in one of the surfaces thereof to serve as receptacles for reaction vessels. In a further alternative embodiment, the tempering block 13 can also have a substantially planar surface without receptacles for reaction vessels. Such a tempering block 13 may be intended, for example, for use with 1536 microtiter plates or in-situ PCR. The surface of the tempering block 13 with or without receptacles, or the upper edges or openings thereof, are essentially located in a horizontal plane, which is also referred to here as the plane in which the tempering block 13 is oriented. The microtiter plate 5 is oriented parallel to this plane during operation of the device. When the front surface of the heatable cover plate 7 bears against the microtiter plate 5, it is likewise oriented parallel to this plane.

The tempering block 13 can be heated and cooled by means of a temperature-regulating device (not shown), whereby the tempering block 13 thus pass through temperature cycles in rapid succession for carrying out polymerase chain reactions. The temperature-regulating device is designed in a conventional manner and is therefore not described in more detail here.

A cover drive 8 for moving the cover 3 is arranged in the base unit 2. The cover drive 8 is coupled to the connecting elements 6 via a respective coupling device, which will be described in more detail below. In the sectional view shown in FIGS. 2*a*-2*e*, only one of the coupling devices can be seen which couples the cover drive 8 to one of the connecting elements 6. A coupling device, which is designed in an analogous manner (symmetrically to the coupling device shown here) and which couples the cover drive 8 to the second connecting element 6 arranged on the opposite side of the cover, is arranged on the opposite side of the base unit. The visible coupling device will be described hereafter.

The cover drive 8 comprises a motor (not visible in FIGS. 2*a*-2*e*) and a drive shaft (not visible in FIGS. 2*a*-2*e*) rotatable about an (imaginary) rotational axis R. The drive shaft is rigidly connected to the lever arm 9 extending perpendicularly to the rotational axis R. A linear guide 10 in which the lever arm 9 is guided is arranged on the connecting element 6. The linear guide 10 is attached to the connecting element 6 so as to rotate about an (imaginary) second rotational axis extending parallel to the rotational axis R.

A guide plate 11, which is oriented perpendicular to the rotational axis R of the drive shaft, is arranged in the base unit 2. A guide slot 12, which has a first, arc-shaped section and a second, linear section oriented perpendicularly to the microtiter plate 5, is formed in the guide plate 11. The movement of the connecting element 6 caused by the cover drive 8 is guided in the guide slot 12 of the guide plate 11. For this purpose, the connecting element 6 has two pins 30 which are guided in the guide slot 12. As mentioned, a mirror-image coupling device is located on the opposite side of the cover drive 8 in the base unit to drive and guide the movement of the other connecting element 6. Instead of the guides described here, other mechanisms can be used which convert a rotational movement of the drive shaft into a linear movement of the connecting elements 6.

Figure 2A:
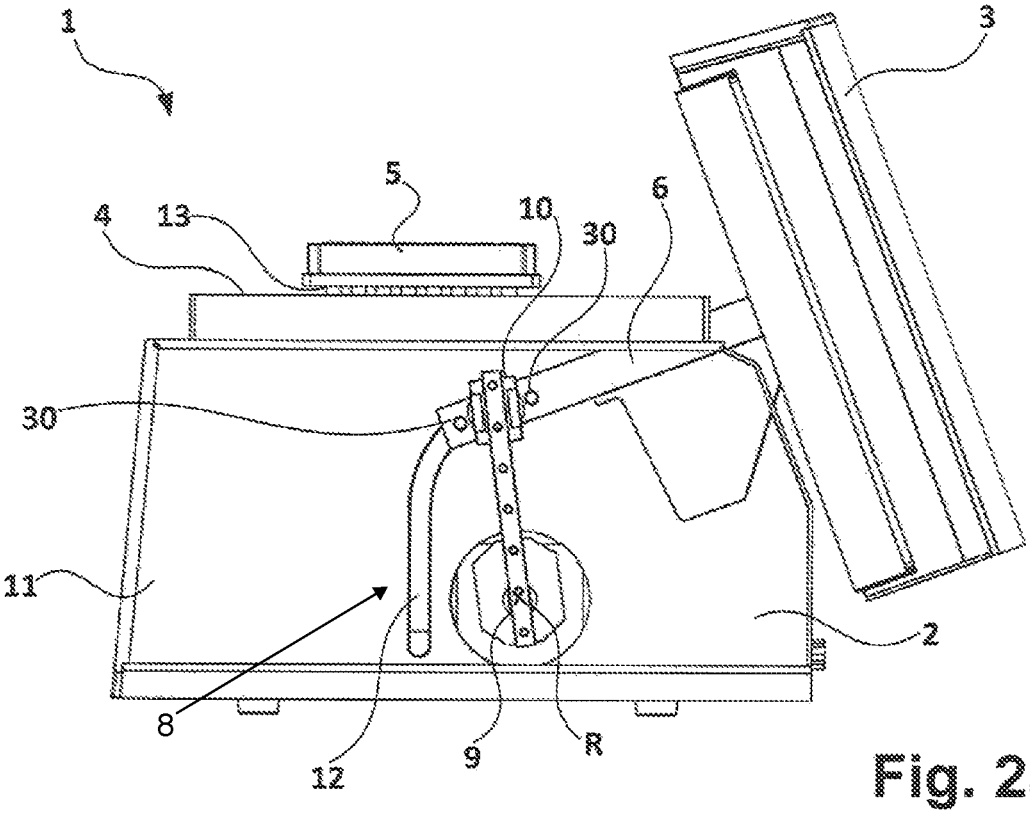
FIGS. 2*a*-2*e* show longitudinal sectional views of the device according to FIGS. 1*a*-1*c* in different positions of the cover with a first sectional plane.
Figure 2B:
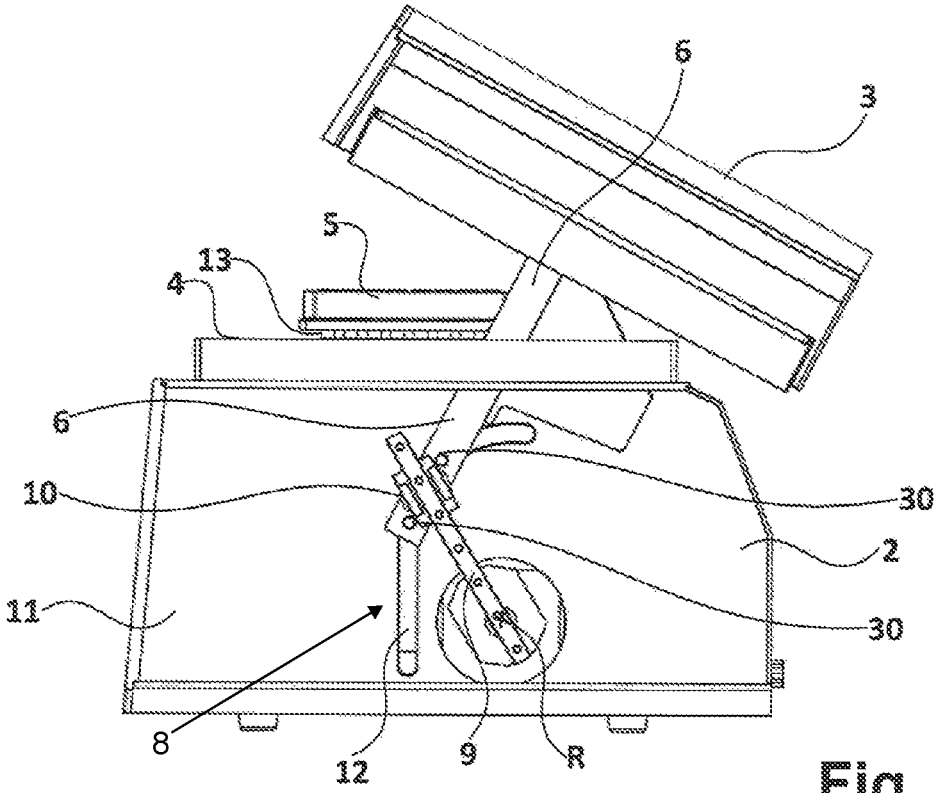
Figure 2C:
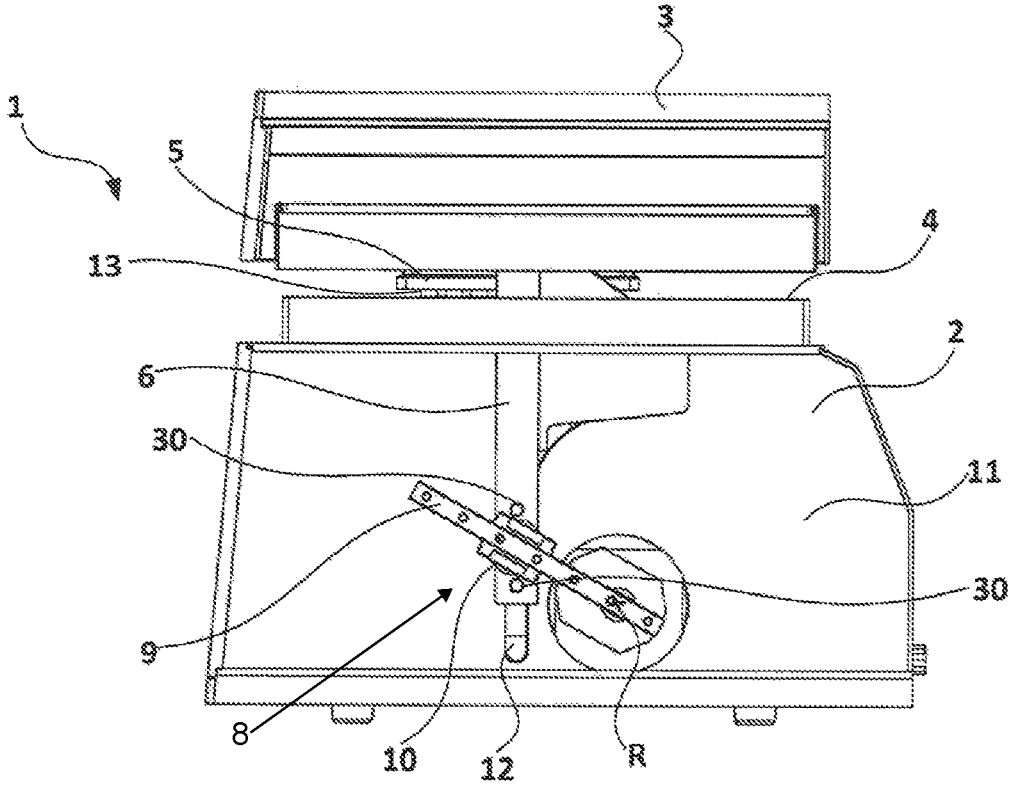
Figure 2D:
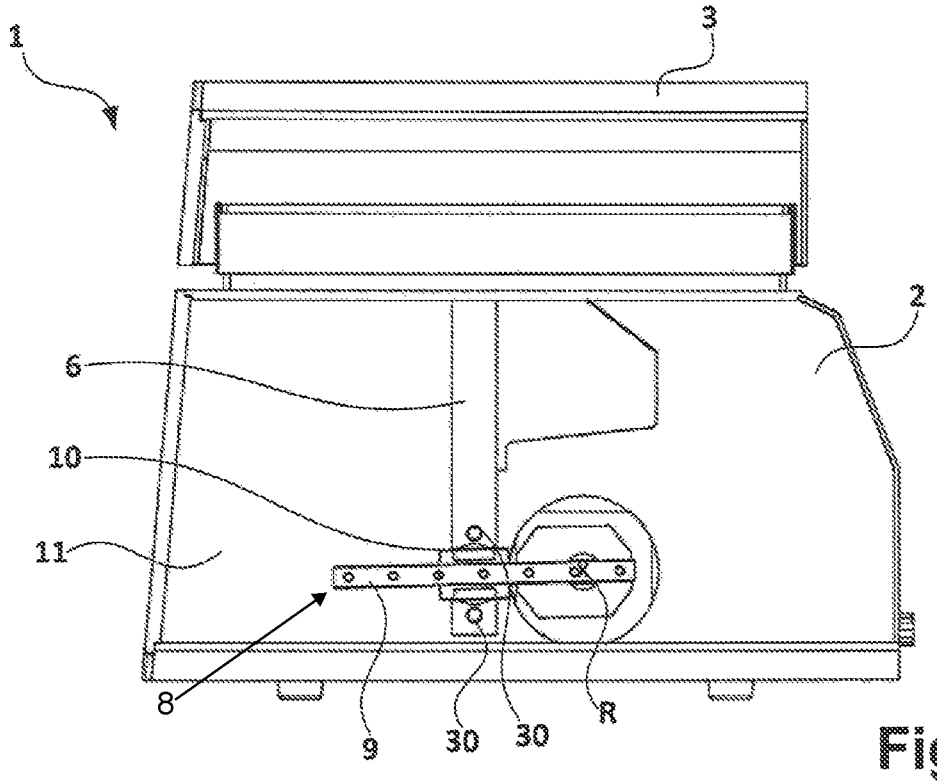
Figure 2E:
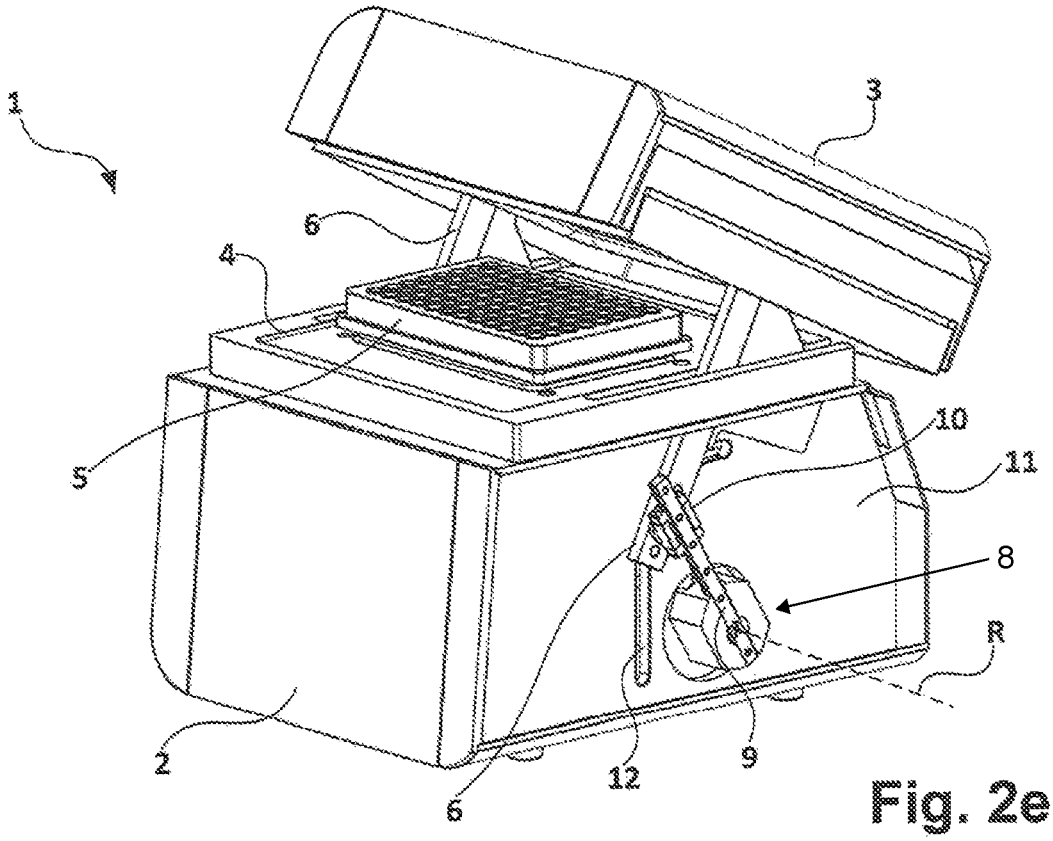

In FIG. 2*a*, the cover 3 is in the first, open position. The pins 30 of the connecting element 6 are located at a first end of the guide slot 12. A rotation of the drive shaft about the rotational axis R causes a movement of the pins along the arc-shaped section of the guide slot 12 via the guidance of the lever arm 9 in the linear guide 10. This movement results in a pivoting movement of the cover 3 over the position shown in FIG. 2*b*, in which the inclination of the cover 3 or of the cover plate 7 arranged therein becomes increasingly smaller with respect to the plane in which the tempering block 13 is arranged, until the cover 3 and the cover plate 7 are oriented parallel to this plane or to the microtiter plate 5, but are still spaced from the microtiter plate 5. This ends the first movement segment, and the third position of the cover 3 is reached, as shown in FIG. 2*c*. The further movement of the drive shaft causes a linear downward movement of the connecting element 6 in the guide slot 12 via the linear guide 10, so that the cover 3 and the cover plate 7 arranged therein move in a perpendicular direction towards the microtiter plate 5, in a manner oriented parallel to the microtiter plate 5, until the front surface of the cover plate 7 strikes against the microtiter plate 5. Ideally, no horizontal force components (shearing forces) whatsoever are exerted on the microtiter plate 5.

A pressing force of the front surface of the cover plate 7 against the microtiter plate 5 is caused by a further rotational movement of the drive shaft. This can be predefined by the torque of the drive shaft or by the force which is accordingly exerted on the connecting elements 6 by the cover drive 8 via the coupling device. When the cover plate 7 bears against the microtiter plate 5 with the predefined contact pressure, the second position of the cover 3 (FIG. 2*d*) is reached.

The rotational movement of the drive shaft in the opposite direction causes a movement correspondingly running in the opposite direction and guided in the guide slot 12, of the cover 3, together with the cover plate 7, from the second position via the third position into the first position.

Alternative embodiments of the coupling unit between the cover drive 8 and the connecting elements 6 or the cover 3 are conceivable. For example, instead of the linear guide 10 for the lever arm 9, a combination of a guide slot and an elongated hole can also be used for coupling the lever arm 9 to the connecting element 6.

Figure 3A:
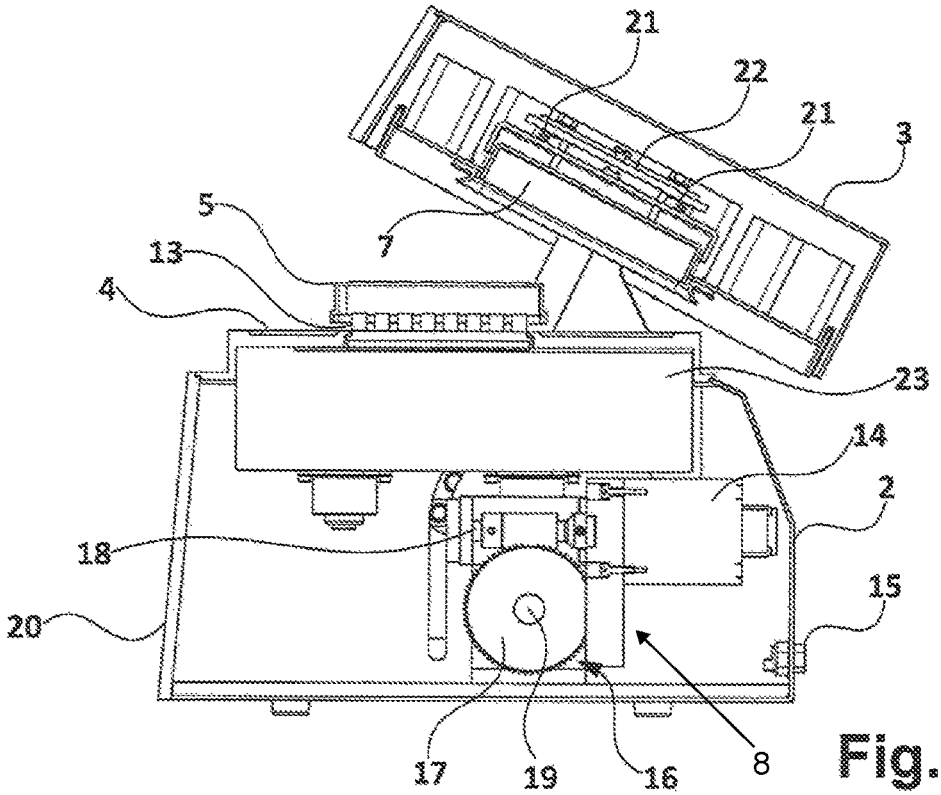
FIGS. 3*a* and 3*b* show longitudinal sectional views of the device according to FIGS. 1*a*-1*c* with a second sectional plane.
Figure 3B:
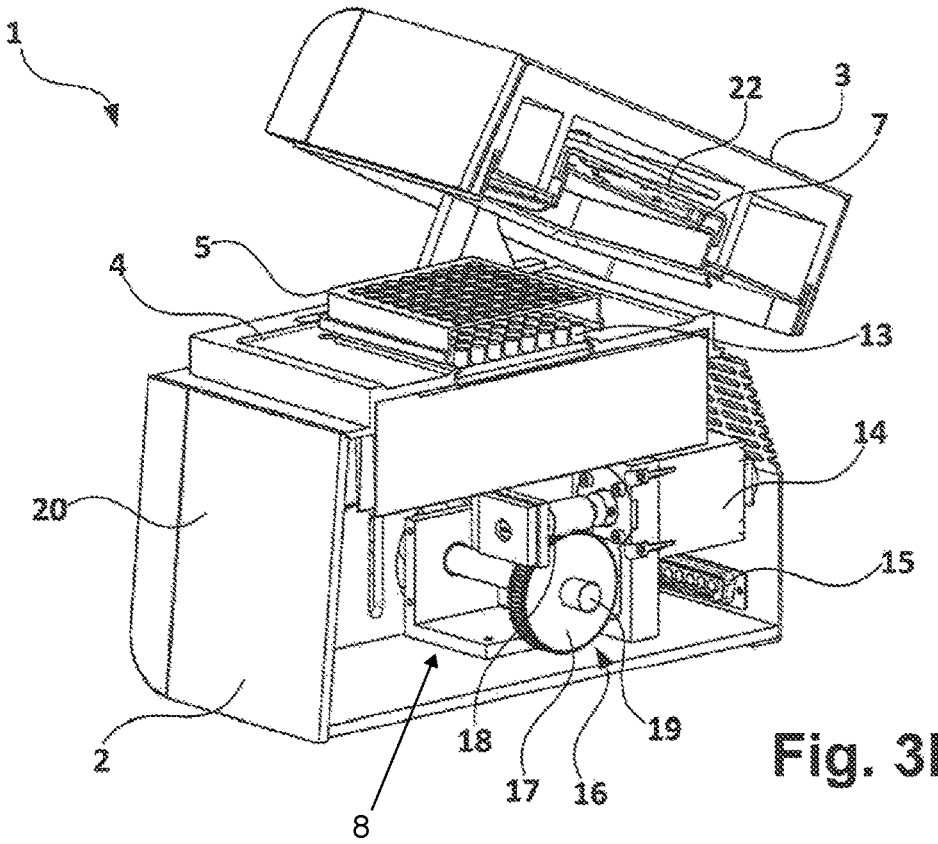

FIGS. 3*a* and 3*b* show further schematic sectional views of the device 1, wherein the second sectional plane considered here extends parallel to the first sectional plane used in FIG. 2*a*-2*e*. The cover drive 8 can be seen in more detail in these sectional views. The cover drive 8 comprises a controllable motor 14, for example, an electric motor, which can be connected to a drive control unit provided in the base unit 2 itself or outside the base unit 2. An interface 15 is provided in the base unit 2 for connecting the motor 14 or the internal drive control unit to an external drive control unit. In the present example, the cover drive 8 further comprises a, preferably self-locking, gear system 16 which can be actuated by the motor 14. In the present exemplary embodiment, the gear system 16 is designed as a worm gear mechanism, but other embodiments that are able to cause the rotational movement of a drive shaft are also possible. The gear system 16 in the present example includes a gear wheel 17 (e.g., a worm gear) and a helical worm shaft 18, the rotational movement of which causes the gear wheel 17 to rotate. The gear wheel 17 is rigidly connected to the drive shaft 19 already mentioned above in connection with FIG. 2*a*-2*e*, which drives the movement of the cover 3 via the lever arm 9, the linear guide 10 and the connecting element 6 guided in the guide slot 12.

To control the cover drive 8, an external drive control unit connected to the motor 14 via the interface 15 may be provided. However, in certain embodiments a drive control unit may be arranged at least partially in the base unit 2, for example, in the form of a circuit implemented on a circuit board arranged in the base unit 2. The drive control unit may include at least one processor, memory elements, and one or more operating programs stored in one or more of the memory elements and executable by the processor. The operating program is, or the operating programs are, used to operate and control the device 1, for example, for controlling the cover drive 8. The drive control unit can be configured, by means of an operating program, to read in an identifier of a reaction vessel, for example a microtiter plate 5, to be inserted into the receiving region 4, to determine, based on the identifier, a pressing force suitable for the specific reaction vessel with which the cover plate 7 is to bear against the reaction vessel when the cover 3 is in the second position, and to control the cover drive 8 for applying the determined pressing force.

The front housing wall 20 of the housing of the base unit 2 is designed to be removable. In this way, the worm shaft 18 is accessible from the outside for emergency release. In the event that the cover 3 cannot be opened automatically, for example, in the case of a defect, the worm shaft 18 may be actuated manually, for example, by means of a screwdriver, and to thus open the cover manually so as to reach the microtiter plate 5 and the samples contained therein.

The sectional views of FIGS. 3*a* and 3*b* also show the design of the cover 3 in detail. As described, the cover 3 contains the cover plate 7, which can be heated by means of a heating module. This is coupled via pressure springs 21 to a pressing panel 22 which in turn is rigidly connected to the connecting elements 6. The force exerted by the cover drive 8 on the connecting elements 6 is transmitted to the cover plate 7 via the pressure springs 21. The heating module is designed in a conventional manner and can be connected to a power supply via the interface 15 of the base unit 2.

The sectional views of FIGS. 3*a* and 3*b* also show a portion of the tempering block module 23 on which the tempering block 13 is mounted. This will be described in more detail based on FIG. 4 and FIG. 5.

Figure 4:
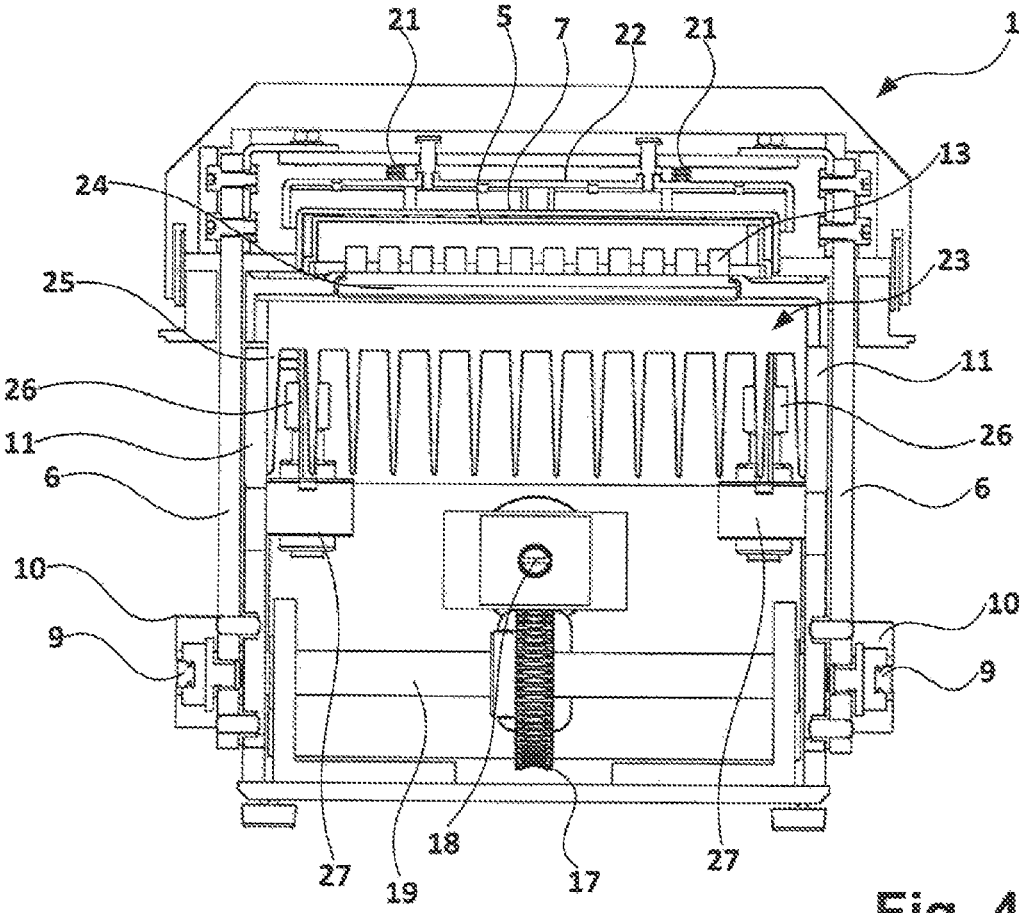
FIG. 4 shows a longitudinal sectional view of the device according to FIGS. 1*a*-1*c* with a third sectional plane extending perpendicular to the first and second sectional planes.

FIG. 4 shows a schematic longitudinal sectional view of the device 1 when the cover is closed (i.e., second position) along a third sectional plane, which extends perpendicularly to the first (FIGS. 2*a*-2*e*) and second (FIGS. 3*a* and 3*b*) sectional planes. In this view, it is apparent that the coupling device between the gear system 16 and the connecting elements 6 has a mirror-image design with respect to an (imaginary) plane of symmetry extending through the gear wheel 17 of the gear system 16. Each of the connecting elements 6 is therefore coupled to the drive shaft 19 via a lever arm 9 guided in a linear guide 10, wherein the movement of the connecting elements 6 is guided in each case by two pins 30, which can be moved in a guide slot of a guide plate 11 and are fixedly connected to one of the connecting elements 6.

The tempering block module 23 including the tempering block 13 is arranged in the upper region of the base unit 2. It includes temperature-control elements 24, for example Peltier elements, arranged beneath the tempering block 13, and a heat sink 25 arranged on the side of the temperature-control elements 24 facing away from the tempering block 13. A temperature control unit can be provided in the base unit 2, which controls or regulates the temperature-control elements 24 for operating through predefined temperature profiles, for example, temperature cycles for carrying out polymerase chain reactions or for incubation. The temperature control unit can also be implemented at least partially in an external controller connected to the temperature-control elements via the interface 15. In the present exemplary embodiment, four ejection plungers 26 are moreover arranged in the tempering block module 23, each being assigned a dedicated drive 27. Of course, a different number of ejection plungers is also conceivable.

Figure 5:
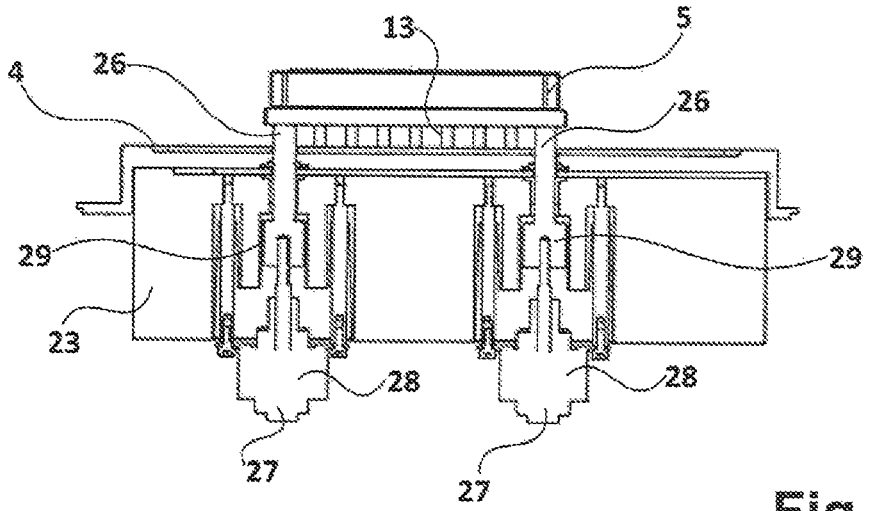
FIG. 5 shows a detailed view of a section through a tempering block module of the device according to FIGS. 1*a*-1*c*, including an ejection mechanism.

FIG. 5 shows the tempering block module 23 including the tempering block 13, the microtiter plate 5 placed thereon, and two of the four ejection plungers 26 in more detail in a longitudinal sectional view. In this view, the temperature-control elements 24 are omitted for the sake of clarity.

The ejection plungers 26 can be moved back and forth by means of the plunger drives 27 in a perpendicular direction to the plane of the tempering block 13 or to the microtiter plate 5 between a first end position (FIG. 5) extended from the tempering block module 23, and a second end position retracted into the tempering block module 23. The ejection plungers 26 are arranged on the periphery of the tempering block 13 in such a way that the ejection plungers 26 strike against the underside of the microtiter plate 5 during the movement from the retracted position into the extended position, and entrain the microtiter plate 5 during their further upward movement. When the extended end position of the ejection plungers 26 is reached, the entrained microtiter plate 5 is lifted off the tempering block 13 such that, for example, a robot gripper arm operated in an automated manner can easily grip it. In the present exemplary embodiment, the ejection plungers 26 are arranged at the corners of the rectangular base area of the tempering block 13. It is possible to provide additional ejection plungers 26 along the sides of the base area or to provide ejection plungers 26 only on the sides. Of course, base areas for the tempering block 13 other than rectangular ones are also conceivable. The ejection plungers 26 are then accordingly arranged in suitable positions along the periphery of the tempering block 13.

The plunger drives 27 can be designed as electric drives, but also as pneumatic or hydraulic drives in certain embodiments. In the present example, the plunger drives 27 each include an electric motor 28 which can be individually controlled by the drive control unit and is coupled to the ejection plunger 26 via a spindle 29 translating a rotational movement of the motor 28 into a linear movement of the ejection plunger 26.

The drive control unit is designed to individually control each plunger drive 27. Thus, it is possible to implement different movement patterns of the ejection plungers 26. For example, the ejection plungers 26 can be moved synchronously to keep the microtiter plate 5 in an exactly horizontal orientation during the ejection movement. During the thermal treatment of the sample, the plastic material of the microtiter plate 5 at the tempering block 13 may start to partially flow and "bake" onto the receptacles of the tempering block 13. To detach the liquid-filled reaction vessels from the receptacles without excessive vibrations, the drive control unit can advantageously be configured to activate the plunger drives 27 such that these alternately reach the extended position so that the microtiter plate 5 is lifted off the tempering block 13 in a pulsating or wave-like movement. Such activation avoids jerky movements, which would cause liquid contained in the individual reaction vessels to wet and adhere to a sealing mat or sealing film closing the reaction vessels, and thus be lost for the further use of the samples.

In the very advantageous exemplary embodiment described here, the drive control unit is designed both to control the cover drive 8 for the movement of the cover 3 and to control the plunger drives 27. In this case, the drive control unit can be designed to match the movement of the cover and the movement of the ejection plungers 26 according to a predefined operating program. Thus, when the cover 3 is lifted from the second position into the third position, the drive control unit at the same time can move the ejection plungers 26 into the extended position so that the microtiter plate remains pressed against the front surface of the cover plate while it is being lifted off the tempering block 13. As the microtiter plate 5 is being lifted off, the reaction vessels thus remain tightly closed by means of the cover plate 7 and protected against jerky movements when the microtiter plate is being detached from the tempering block.

The device described here is suitable for automatic actuation, provides high operational reliability, and has a space-saving and simple design.

The invention claimed is:

1. A device for a thermal treatment of samples, comprising:

a base unit including a receiving region configured for receiving one or more reaction vessels;

a tempering block disposed in the receiving region;

a cover configured to close off the receiving region and to translate from an open first position to a closed second position, the cover including a cover plate having a front surface, the front surface configured to apply a pressing force against reaction vessels disposed on the tempering block when the cover is in the second position;

at least one connecting element connected to the cover; and a cover drive disposed in the base unit and coupled to the at least one connecting element as to drive the translation of the cover from the first position to the second position and from the second position to the first position, wherein the cover drive is coupled to the at least one connecting element such that, during the translation from the first position to the second position, the cover with the cover plate, in a first movement segment, is initially translated from the first position into a third position in which the front surface of the cover plate extends parallel to and spaced from the tempering block, and that the cover with the cover plate, in a subsequent second movement segment, is translated from the third position in a direction of a shared normal of the front surface and a plane in which the tempering block is disposed, the second movement segment continuing toward the receiving region of the base unit until the cover has reached the second position, wherein, in the first position of the cover, the front surface of the cover plate is inclined with respect to the tempering block.

2. The device of claim 1, wherein the cover drive is adapted to be controlled for setting the pressing force acting perpendicularly to the front surface of the cover plate, which the cover drive exerts on the cover and the cover plate via the at least one connecting element during the second movement segment.

3. The device of claim 1, wherein the cover drive includes an electric motor, and wherein the device further comprises a drive control unit connected or connectable to the cover drive and configured to set the pressing force that the cover drive exerts on the cover and cover plate via the at least one connecting element, wherein the set pressing force is based on a specification by a user or a higher-level control unit in communication with the drive control unit.

4. The device of claim 3, wherein the drive control unit and/or the higher-level control unit are configured to generate and output a control signal representing the pressing force to be set, the control signal based on a identifier of one or more reaction vessels received in the base unit.

5. The device of claim 1, wherein the at least one connecting element is coupled to a guide disposed in the base unit such that movement of the at least one connecting element during the second movement segment is guided linearly in the direction perpendicular to the cover plate.

6. The device of claim 5, wherein a section of the guide that guides the movement of the at least one connecting element during the second movement segment extends perpendicularly to the plane in which the tempering block is disposed.

7. The device of claim 1, wherein the cover drive comprises a rotatable drive shaft that is rigidly connected to at least one lever arm extending perpendicularly to the drive shaft, the lever arm coupled to the at least one connecting element via a guide.

8. The device of claim 7, wherein the guide is a linear guide for the lever arm mounted rotatably on the at least one connecting element.

9. The device of claim 7, wherein the guide includes a guide slot, arranged in the lever arm or the at least one connecting element, and at least one pin movable in the guide slot.

10. The device of claim 1, wherein a movement of the at least one connecting element during the first movement segment and second movement segment is guided in a guide disposed in the base unit.

11. The device of claim 10, wherein the at least one connecting element includes at least one coupling element, and wherein the guide includes a guide plate including a guide slot in which the coupling element is guided.

12. The device of claim 1, further comprising two connecting elements attached on opposite sides of the cover.

13. The device of claim 1, wherein the cover drive comprises a self-locking gear system.

14. The device of claim 13, wherein the self-locking gear system is a worm gear mechanism.

15. The device of claim 1, wherein the base unit includes a housing that includes at least one opening that can be closed, which allows access for manual actuation of the cover drive.

16. The device of claim 1, wherein the base unit includes an ejection mechanism that can be automatically actuated by one or more motors and is configured to move reaction vessels disposed on the tempering block in a direction of a normal of the plane in which the tempering block is disposed.

17. The device claim 16, wherein the tempering block is disposed on or in a tempering block module attached in the base unit, wherein the ejection mechanism includes at least one ejection plunger movably mounted in the tempering block module perpendicularly to the plane in which the tempering block is disposed, and wherein, for driving movements of the ejection plunger, the device further comprises at least one plunger drive arranged on the underside of the tempering block module, wherein a dedicated plunger drive actuates each ejection plunger.

* * * * *